US006019142A

United States Patent [19]

Kurmis

[11] Patent Number: 6,019,142

[45] Date of Patent: Feb. 1, 2000

[54] TOOL AND ARRANGEMENT FOR FASTENING AN ARTICLE BY MEANS OF A BAND

[75] Inventor: Viktor Kurmis, Pinneberg, Germany

[73] Assignee: Paul Hellermann GmbH, Pinneberg, Germany

[21] Appl. No.: 09/135,142

[22] Filed: Aug. 17, 1998

[30] Foreign Application Priority Data

Aug. 19, 1997 [DE] Germany ..... 297 14 836 U
Oct. 7, 1997 [DE] Germany ..... 297 17 857 U

[51] Int. Cl.[7] ..... B21F 9/02

[52] U.S. Cl. ..... 140/93 A; 140/123.6

[58] Field of Search ..... 140/93, 93 A, 140/93.2, 119, 123.6

[56] References Cited

U.S. PATENT DOCUMENTS

| | | | |
|---|---|---|---|
| 3,033,102 | 5/1962 | Fryklund | 100/14 |
| 3,621,889 | 11/1971 | Hidassy | 140/93.2 |
| 3,810,498 | 5/1974 | Hidassy | 140/93 A |
| 3,976,108 | 8/1976 | Caveney et al. | 140/93 A |
| 4,371,010 | 2/1983 | Hidassy | 140/93 A |
| 5,430,996 | 7/1995 | Kurmis | 53/589 |

FOREIGN PATENT DOCUMENTS 0 428 116 B1 7/1992 European Pat. Off. .

*Primary Examiner*—Lowell A. Larson
*Attorney, Agent, or Firm*—Alix, Yale & Ristas, LLP

[57] ABSTRACT

Tool for fastening an article, in particular a cable harness, by means of a band to be closed by a lock (10), which has, at a front surface of its tool body (1), a wraparound clamp (4) formed at least partially of clamp parts (5) movably held at the tool body (1), a lock mount (9), a tensioning device for tensioning the band guided in the wraparound clamp (4) and through the lock (10), and a control device for opening the wraparound clamp (4) and tensioning the band, in which the control device is designed in such a way that, before the completion of the tensioning of the band, the wraparound clamp (4) is opened and is retracted through a substantial part of its forward overhang. Furthermore, in the case of an arrangement for fastening an article, in particular a cable harness (12), with the enclosing of a securing lug (7) by means of a flexible band, there is provided a tool which forms a wraparound guide, formed at least partially of clamp parts (5) movably held at the tool body (1), for guiding the band around the article (12), in which the free ends (49) of the clamp parts (5) adjoin the securing lug (7) in their closed condition and the latter forms a part of the wraparound guide.

16 Claims, 7 Drawing Sheets

TOOL AND ARRANGEMENT FOR FASTENING AN ARTICLE BY MEANS OF A BAND

FIELD OF THE INVENTION

The invention relates to a tool for fastening an article, in particular a cable harness, by means of a band to be closed by a lock. The tool has at the front of its tool body a wraparound clamp, which is formed at least partially by clamp parts movably held at the tool body, and a lock mount. A tensioning device for tensioning the band guided in the wraparound clamp and by the lock and a control device for opening the wraparound clamp and for tensioning the band are further present.

BACKGROUND OF THE INVENTION

In known tools of this type (EP 0 428 116, U.S. Pat. No. 4,371,010, U.S. Pat. No. 3,976,108), the clamp parts are pivotably borne by means of an articulation point directly at the tool body, while at another articulation point there engages an actuating element by which the opening and closing movement is generated. In the course of opening, the clamp parts pivot so far to the side in the circular arc that an article to be fastened can be guided through. The wraparound clamp is closed around the article to be fastened and forms, in this condition, a closed guide for a band to be wrapped around the article. In a further known fastening tool (U.S. Pat. No. 3,810,498), the wraparound clamp does not need to be closed completely, specifically in circumstances in which an excessively large article is situated between the clamps and a complete closing of the clamps is not possible; in this case, it is tolerated that in the circumstances no completely closed guide for the band is available. The band is guided in the guide around the article. The lock for fastening the band may be a separate part or may be connected in integral fashion to the rear end of the band. At the very latest, at the end of the wraparound process, it is received by the lock mount. The leading end of the band is then guided through an opening in the lock and grasped by the tensioning device. In the course of tensioning, the band is set onto the article; in this case, the article is drawn to the lock mount or, if the article is stationary, the tool with its lock mount is drawn to the article. This presupposes that sufficient space for the clamp parts projecting from the tool body is present beyond the article. However, in many cases an obstruction is situated in the vicinity, beyond the article; this may be, for example, a carrying structure in the cases in which the band serves to secure the article to a securing lug which, for its part, is connected to the carrying structure. In these circumstances, the clamp parts projecting from the tool body impact against the carrying structure and thus prevent a situation in which the tool can be drawn to the article. Instead, a force is exerted on the article, which force tends to draw it to the lock mount; in this case, a resultant disadvantageous consequence may be that the article is moved out of its position, whereby it itself or components such as the securing lugs which seek to hold it in its position may be damaged. Furthermore, a fastening tool is known (U.S. Pat. No. 3,621,889), in which, during the tensioning procedure, the lock mount is moved away from the tool body, i.e. runs towards the article to be fastened. This does indeed reduce the risk of damage to components which hold the article to be fastened in its position, but, in this case, it is a disadvantage that it may happen that, after the fastening procedure, the band does not have the desired band tension, since it was not possible for the lock mount to approach the article fully. The known tools frequently make additional, costly manual work necessary.

SUMMARY OF THE INVENTION

The object of the invention is to avoid these disadvantages.

The invention has recognized that the fastening of an article can take place without any problem in circumstances in which the clamp parts projecting from the tool body, which have been swung out, are removed, at the latest during the tensioning of the band, from the region lying beyond the article. The invention makes this possible in that it makes available a tool in the case of which the wraparound clamp is opened before or during the tensioning of the band, and the wraparound clamp is retractable through a substantial part of the overhang which it exhibits in the closed condition in the forward direction. In contrast to known tools, in the case of which the opening pivotal movement of the clamp parts is restricted to a circular arc, which leads principally to the side and comprises only a minor rearwardly directed component, in the case of the tool according to the invention there is provided a rearwardly directed movement which is superposed upon the lateral opening movement or which follows the same.

The wraparound clamp is retracted to a significant extent in relation to its transverse movement. As a result of this, not only is it achieved that the fastening of an article and, where appropriate, the simultaneous connection thereof to a stationary mounting, is in all cases possible without any problem; in addition, it is made possible to fasten articles which lie in the immediate vicinity of any obstructions whatsoever, such as for example a carrying structure, without the clamp parts impacting against these obstructions. With the tool according to the invention, fastening in a tightly limited space is consequently also possible.

The fact that the wraparound clamp is retracted through a substantial part of the overhang which it exhibits in the closed condition in the forward direction means, preferably, that it is retractable through at least one half of its forwardly directed overhang. In this case, the overhang is to be measured proceeding from the lock mount. Further, it should be retractable preferably through at least one quarter, further preferably through at least one half of its maximum opening width.

The opening movement can begin as soon as the band has been grasped by the tensioning device. As against this, the retraction movement must be coordinated with the opening movement so that the narrowest parts of the clamp—that is to say, in general, the clamp tips—are guided sufficiently widely around the contour of the article to be fastened. This demands that a strong retraction movement does not take place until the clamp has opened to a width which is at least approximately as great as the breadth of the article.

In an advantageous embodiment of the invention, there are provided at the swivellable clamp parts in each instance two articulation points which are guided along predetermined tracks at the tool body. By appropriate design of the progression of the predetermined tracks, it is possible to control the movement progression of the clamps in the desired manner. An advantageous possible design for such a guide track is the arrangement of an articulation point at the end of a steering gear, the other end of which is pivotably connected to the tool body. This guide track is then designed as a circular arc. This does not mean that the parts of the clamp which form the wraparound guide must also move along a circular arc, since this is also further dependent upon the form of the other guide track. The latter may likewise be formed from a steering gear connected to the tool. In another embodiment, it is formed by a sliding guide at the tool body and a slide cooperating therewith; in this case, the slide is connected to the second articulation point.

The use of the tool for bands of differing cross-sectional dimensions and lengths may make it necessary to exchange the wraparound clamp. In the case of known tools, this takes place in that the pivotal and drive connections of the clamp with the tool body are designed in releasable fashion. This is possible also in conjunction with the present invention. Since, however, an additional guide connection is provided, it is as a rule more complicated. Accordingly, the invention provides that the entire clamp parts are not exchanged, but the clamp parts are composed of an exchangeable, front part and a nonexchangeable base part, at which the articulation points and the drive connection are at least partially disposed.

Furthermore, it may be expedient if the free ends of the clamp parts are provided with a positive locking connection to a securing lug; in this case, the securing lug then forms a part of the wraparound guide.

This guarantees a smooth passage of the wraparound guide in the region of the securing lug as well, so that disturbances due to a band passage obstructed at this position are not to be feared during the wrapping around. Furthermore, it is advantageous if the securing lug has, at its side facing the article, at least one projection which engages behind the clamp parts when they are closed on the securing lug. This prevents a situation in which in the closed condition, during the fastening procedure, the tool loses its reliable guidance connection to the securing lug as a result of undesired movement. For this purpose, at least one of the free ends of the clamp parts has a pair of fingers which in the closed condition grip the securing lug between them and which engage behind the laterally disposed projection or projections. However, other positive-locking elements cooperating at the clamp ends and at the securing lug are also feasible, these guaranteeing the mutual connection. By way of example, projections provided at the clamp ends can engage into recesses of the lug. These recesses of the lug can also be formed, in whole or in part, by that passage opening for the band which is situated in the lug.

This is in particular of importance in circumstances in which the securing lug is anchored to a carrying structure. Particularly expedient is the positive locking design of connection of the free ends in the case of exchangeable, front clamp parts; in this case, for differing securing lugs it is possible to provide differing exchangeable, front clamp parts with a positive locking connection which is adapted in each instance to the securing lug.

If—as has just been stated—at least one of the free ends of the clamp parts has a pair of fingers gripping the securing lug, according to a further feature of the invention the breadth dimensioning of the lug in differing directions may take place in such a way that it fits between the fingers only in that position in which its band opening continues the wraparound guide in the clamp parts in aligned fashion. For this purpose, the width of the securing lug, measured transversely to the direction of its band opening, is slightly smaller than or at most equal to the clear spacing of the fingers, while, measured in a direction parallel to the band opening, it is greater than the clear spacing of the fingers from one another.

It is known to design fastening tools in such a way that the wraparound procedure is initiated only when the clamp parts have reached their end position closing the wraparound guide. This feature is particularly expedient in conjunction with the positive locking cooperation of the clamp ends with the securing lug. If, indeed, the end position of the clamp parts cannot be reached until they correctly cooperate, in positive locking fashion, with the securing lug, it is guaranteed that the wraparound procedure can take place only when the position of the securing lug in relation to the tool is correct.

In order to facilitate the setting of the tool onto the securing lug, the latter can be releasably connected to a guiding device which has guide surfaces for the clamp parts, which surfaces lead towards the securing lug. If a setting board is used to hold a cable harness or the like to be fastened, the guiding device should be secured thereto and should have or form a mounting for the securing lug. By this means, not only is the position of the securing lug in relation to the article to be fastened unambiguously determined, but it is also guaranteed that it is situated precisely at that position which corresponds to the position of an anchoring device at the carrying structure, at which the article is to be mounted later. It is possible to take precautions to ensure that the securing lug can be connected to the mounting device only in such a position which corresponds to its desired orientation in relation to the guiding device and to the band direction. For this purpose, orientation means cooperating in positive locking fashion may be provided at the securing element forming the securing lug and the mounting provided therefor.

In addition to or in place of the retractable clamp members, it may be provided that the lock mount moves away from the tool body during tensioning and runs towards the article to be fastened. In this case, the lead of the lock mount is expediently controlled so that diminution of the band loop which arises by reason of the lead of the lock mount and of the lock held therein is no smaller than the free band length transported by the tensioning device. However, the lead of the lock mount can also be implemented passively, i.e. the lock and the lock mount move forwards, without their own drive, as a consequence of that diminution of the band loop which is achieved during the tensioning of the band. Expediently, an opening and retraction of the clamp does not take place until the leading lock mount has reached a position remote from the tool body; advantageously, not until the lock mount or, respectively, the lock held by it finds an abutment on the article to be fastened. Where appropriate, it is also possible entirely to dispense with the opening and retraction movements of the clamp members. An advantage of this embodiment is that the lead of the lock mount is frequently to be executed in simple manner from the drive side, not least for the reason that the movement kinematics demands only a unidimensional longitudinal movement of the lock mount. As a result of the fact that the clamp members are still closed, at least at the start of the tensioning procedure, the tool can be guided easily and with positional accuracy in particular in the cases in which the clamp ends rest against a structure or a securing element.

BRIEF DESCRIPTION OF THE DRAWINGS

In the text which follows, the invention is explained in greater detail with reference to the drawing, which diagrammatically illustrates advantageous illustrative embodiments. In the drawing.

DESCRIPTION OF A PREFERRED EMBODIMENT

Figure 2:
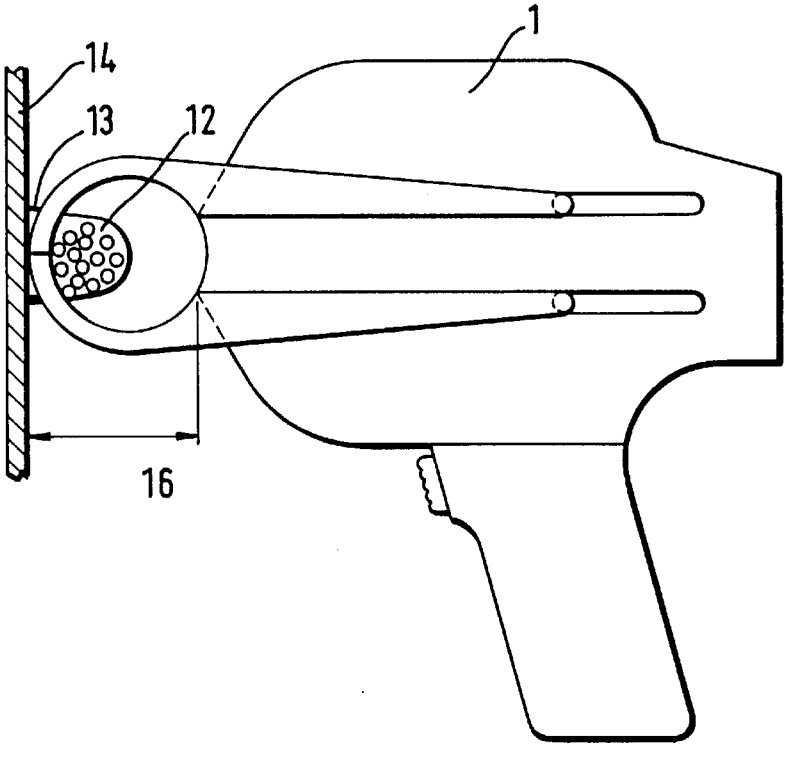
FIGS. 2 and 3 show side elevations of the tool in differing functional settings.
Figure 3:
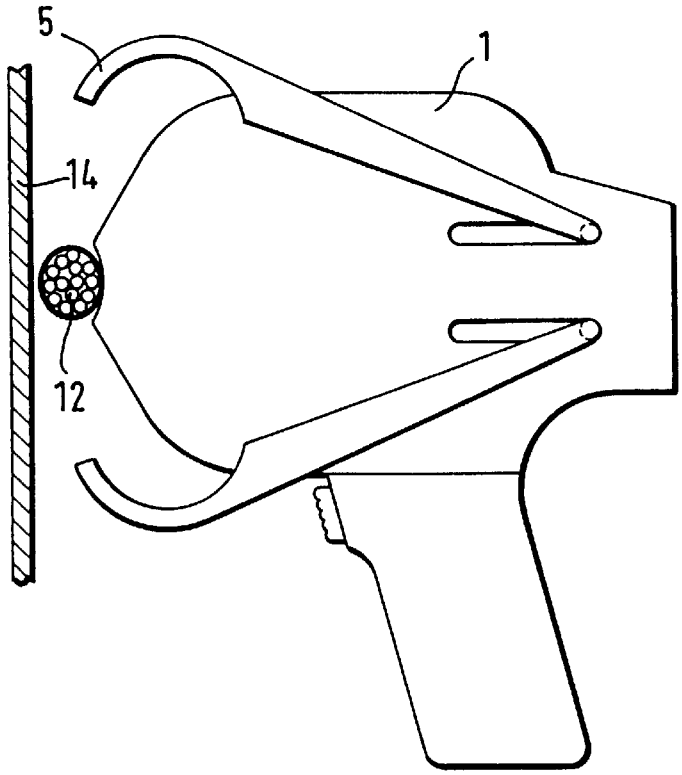

The tool possesses a tool body 1 having a handle 2 which is disposed in pistol-like fashion and at which a release button 3 for initiating the fastening procedure is situated. The tool includes—as is known—a drive motor and a control device for the various tool functions, in particular the movement of the wraparound clamp and the tensioning of the band. At the forward end face of the tool body, which is elongate overall, there is situated the wraparound clamp 4, which is principally formed by two clamp parts 5 which are movably borne on the tool body 1. Moreover, the wraparound guide may be formed in part in the region 6 by the tool body or by parts connected to the tool body. In addition, other parts, such as a securing lug 7 (FIGS. 5, 11–14), which the clamp parts 5 adjoin in the closed condition, may participate in the formation of the wraparound guide. The guide is formed by a groove 8 in the clamp parts 5. A band emerging with its free end forwards from the front of the tool body is guided through the groove 8 around the article to be fastened and back to the front of the tool. There is provided there a lock mount 9 which is diagrammatically represented by the contour of the lock 10 indicated by broken lines. The lock 10 receives the leading end 11 of the band. The latter then passes into a tensioning device (not shown) which draws it tight around the article to be fastened. In this case, the latter is drawn to the lock mount 9 or, conversely, the tool with its lock mount is drawn to the article. This case is indicated in FIGS. 2 and 3. A cable harness 12 to be fastened is fixedly retained at a small spacing in front of the wall 14 by any device 13 which is situated beside the tool (below the plane of the drawing), so that when the wraparound clamp 4 is closed, the cable harness 12 is situated remote from the lock mount 9. From this position, the cable harness 12 cannot be drawn to the lock mount without harmful force, since, on the one hand, it is fixedly held by the device 13 and, on the other hand, the wraparound clamp 4 abutting against the wall 14 prevents the tool from approaching the cable harness. According to the invention, it is accordingly provided that the clamp parts 5 forming the wraparound clamp 4 are withdrawn, in the manner represented in FIG. 3, before the tensioning of the band or, at the latest, during the tensioning. The tool body is now able to approach the cable harness 12. This applies mutatis mutandis in the case represented in FIGS. 8 and 9, when the cable harness 12 is disposed on a setting board 42.

If the extent of the withdrawal is so great that the front end of the clamp parts withdraws for example as far as the front 15 of the lock mount 9, or even there-behind, then adequate clearance is thereby created for any practical application. It is sufficient if they are retractable through their forward overhang minus the minimum thickness of the articles to be fastened. The forward overhang 16 (FIG. 2) is measured from the front 15 of the lock mount 9 to the most forward point of the wraparound clamp 4.

Figure 1:
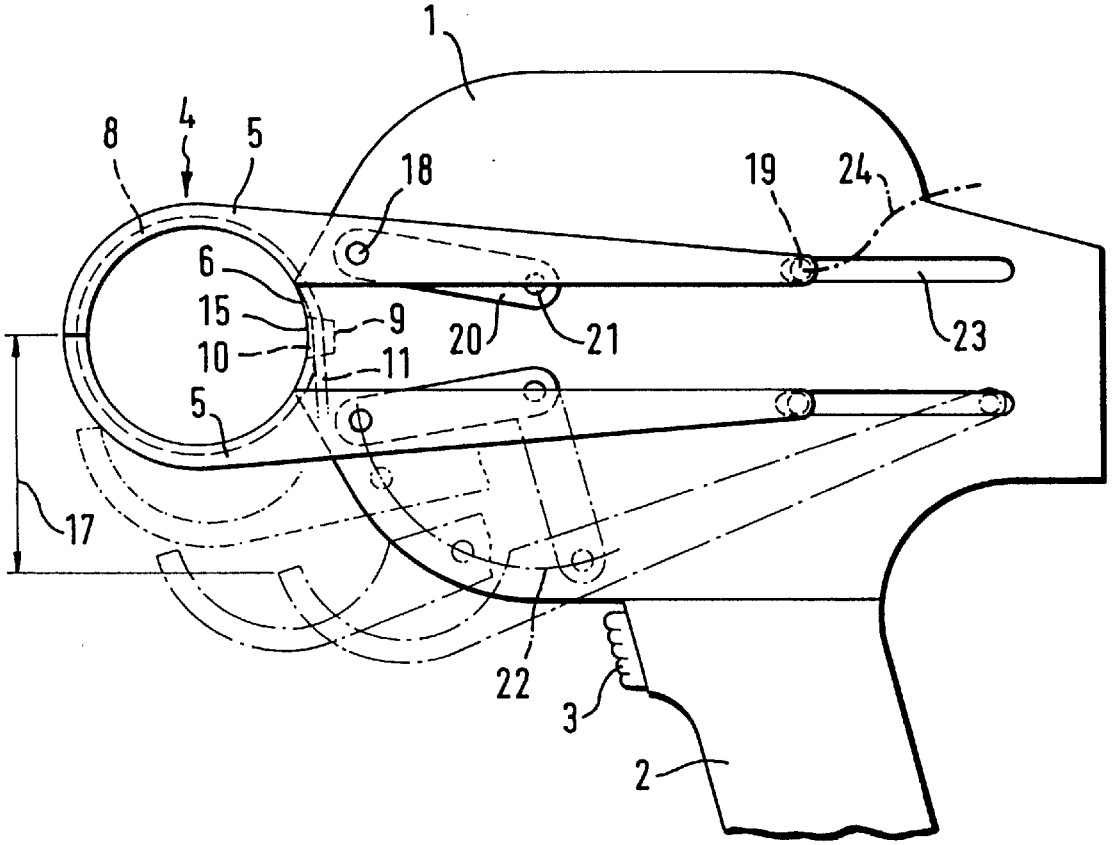
FIG. 1 shows a diagrammatic side elevation of the tool.

The extent, according to the invention, of the retraction of the clamp parts can also be related to their opening width. This is meaningful for the reason that in the case of the known tools, the clamps of which are guided on circular tracks, a relatively small retraction in relation to the path of opening movement takes place. In this connection, what matters is the opening width of the clamp tips in the open condition. In FIG. 1, the opening width 17 of one of the two clamp parts is represented. The total opening width is twice as large. The retraction should amount to at least one quarter of the total opening width.

For the retraction, there is forced on the clamp parts a movement component additional to their opening movement. In the illustrative embodiment according to FIG. 1, this takes place in that each clamp part has two articulation points 18, 19, which are guided on predetermined tracks which are fixedly disposed on the tool body. The articulation point 18 is pivotably disposed at the end of a steering gear 20, the other end of which is pivotably borne at 21 on the tool body 1. The guide track of the articulation point 18 is consequently a circular arc 22. The other articulation point 19 has a slide which is movable forwards and backwards in a guide groove 23. The opening and closing drive can take place in a conventional manner and, by way of example, the steering gear 20 may be connected to a reciprocating swivel drive, or the slide 19 is connected to a drive running to and fro in the longitudinal direction. The guide tracks 22, 23 are coordinated with one another in their form so that the front end of the clamp parts 5 moves in the first instance laterally in the course of opening, in order to be released from the article to be fastened, and then rearwards, as is illustrated by a succession of functional stages shown by chain dotted lines in FIG. 1, for one of the two clamp parts.

The guidance may also take place in any other way. Thus, by way of example, both articulation points may be guided by steering gears on circular arcs, as is shown for the articulation point 18 in the illustrative embodiment. Alternatively, both articulation points are guided in slide guides or the forward articulation point 18 is guided in a slide guide and the rear one 19 on a steering gear.

Figure 4:
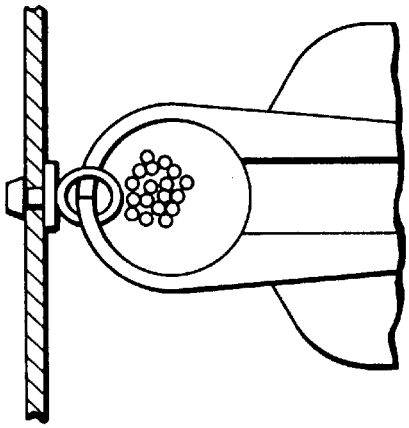
FIGS. 4 and 5 show the use of the tool in the fitting of a cable harness to securing lugs.
Figure 5:
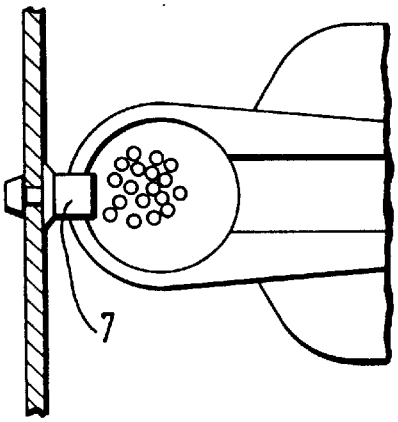

The invention has the advantage that cable fasteners can be fastened, even in circumstances in which they are spatially fixed in front of a wall 14. They can also be fastened to lugs, as is illustrated by the illustrative embodiments in FIGS. 4 and 5.

Figure 6:
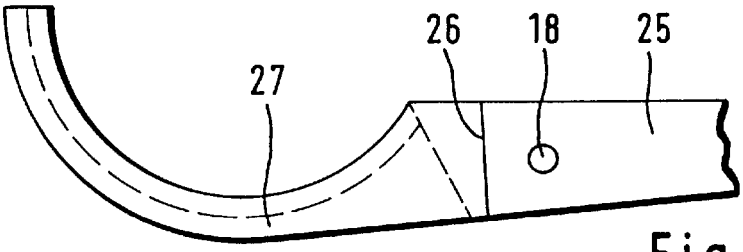
FIG. 6 shows a partial elevation of a clamp part.

In order that it should be possible for cable fasteners of differing dimensions to be used, the clamp parts 5 are designed in divisible fashion. As shown in FIG. 6, they possess a rear base part 25, which comprises the articulation points 18 and 19. This base part is connected, at a joint 26, via releasable connecting means (not shown), to the front part 27, which forms the actual wraparound guide 4 and can be exchanged.

The guide tracks can have a different design. If it is desired, for example, that the lateral movement component of the clamp guides of the last movement phase should be smaller than shown, then it is possible, by way of example, to impart to the guide track 23 the contour which is indicated in FIG. 1 by a chain dotted line 24 and which is directed rearwardly and outwardly.

Figure 7:
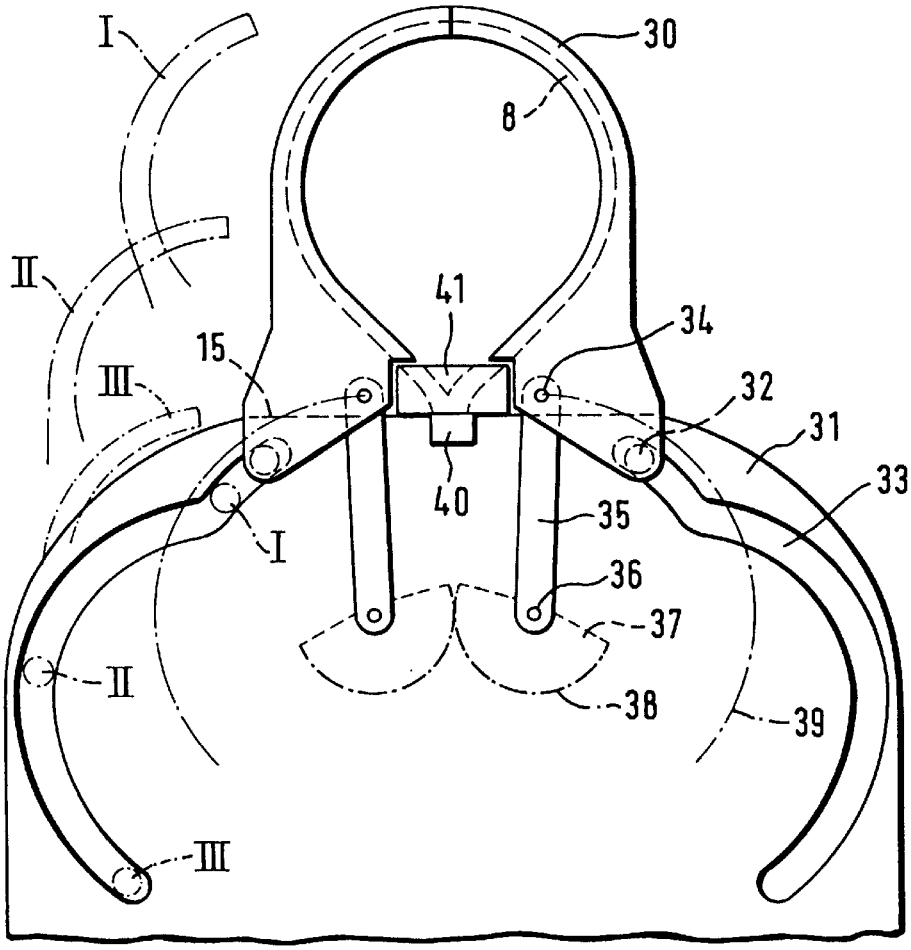
FIG. 7 shows a further embodiment.

An illustrative embodiment of this type is diagrammatically represented in FIG. 7. On the one hand, the clamp parts 30 are held at the tool body 31 by in each case one roller 32 in guide grooves 33. On the other hand, they are guided at the articulation point 34 by a steering gear 35, which is pivotably borne about the fixed point 36 on the tool body 31. The steering gears 35 are connected for symmetrical movement by mutually inter-engaging toothed segments 37, the toothing of which is indicated by part circles 38. Expediently, the drive for the opening movement engages at the swivel shaft of one of the two steering gears 35. In the course of the pivotal movement, the articulation points 34 move on the circular arcs 39 indicated by chain dotted lines, while the rollers 32 remain in the guide grooves 33. A number of stages I to III of the opening pivotal movement are indicated on the left in FIG. 7 by specifying the respective position of the clamp tips and of the rollers 32. It can be seen that the retraction path of the clamp tips is greater than their laterally directed movement path, i.e. the retraction path is greater than half the opening width.

FIG. 7 shows, in front of the lock mount 40, a small block 41 which includes guide grooves for the band which are indicated by broken lines and which pass over into the guide grooves 8 of the wraparound clamp. After the threading-in of the leading band end into the lock mount and before or at the time of commencement of the tensioning, this small block 41 can be pivoted away in such a manner that the lock mount lies in the tool front 15 during tensioning.

Figure 8:
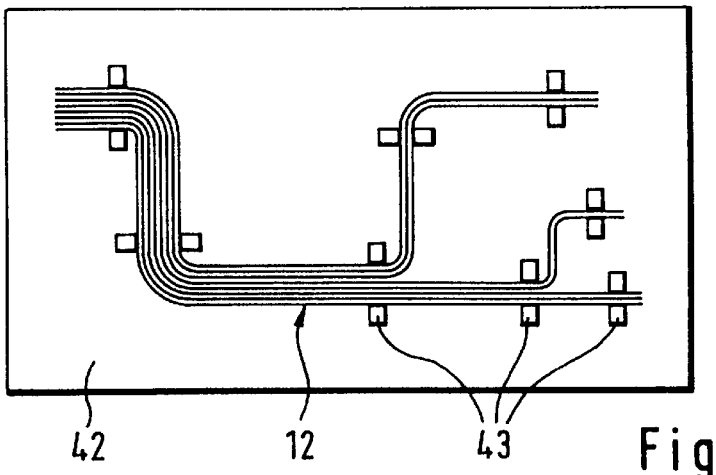
FIG. 8 shows the plan view of a setting board with cable harness.

Frequently, the cable harness 12 is not fastened directly to the carrying structure, but, for the purpose of preparing for its mounting on the carrying structure, is fastened in a fitting manner to a setting board 42 (FIG. 8). A plurality of mounts 43 are secured on the setting board 42 to receive the cable harness 12 to be fastened, which mounts hold the cable harness 12 in the shape which is predetermined for it. As is seen in FIG. 9, the mounts 43 are designed in U-shaped fashion to receive the cable harness 12 in the depression between two limbs 44.

Figure 9:
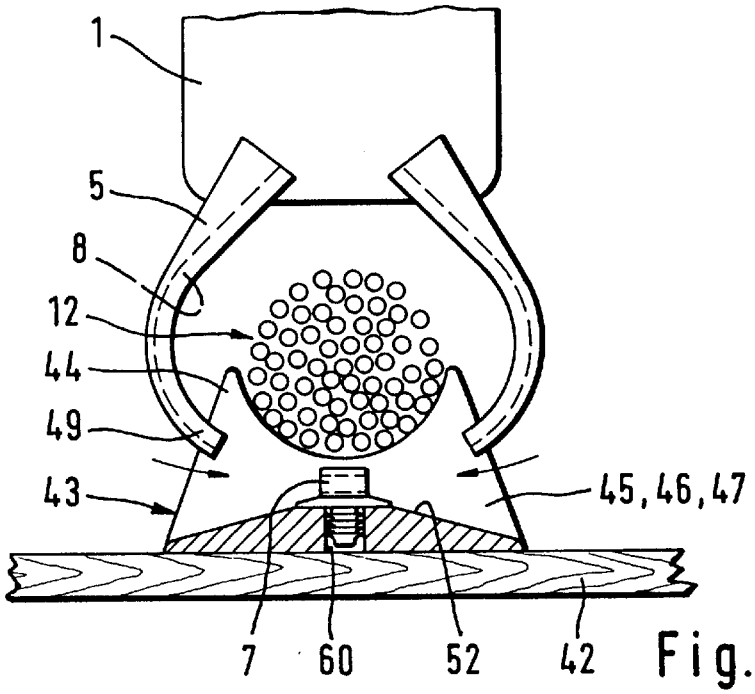
FIG. 9 shows a longitudinal cross-section through a mounting for a cable harness with a part of the tool, according to a further embodiment.
Figure 10:
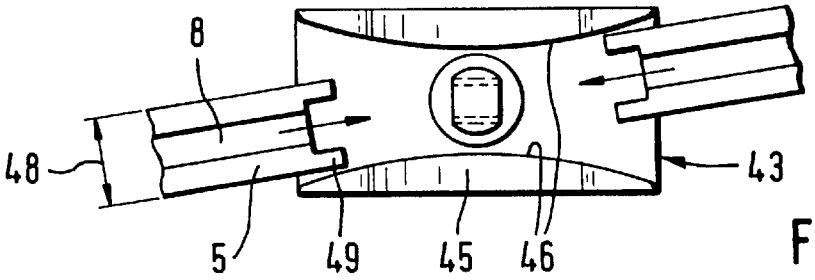
FIGS. 10 and 11 show two plan views of the mounting in differing functional stages of the clamp parts of the tool.
Figure 11:
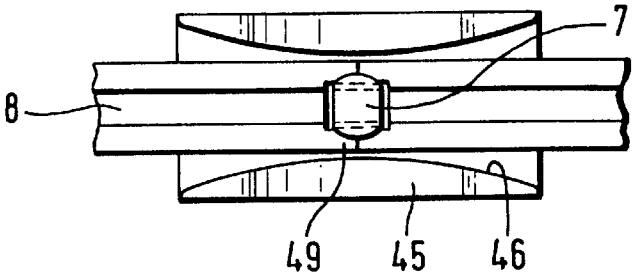
Figure 12:
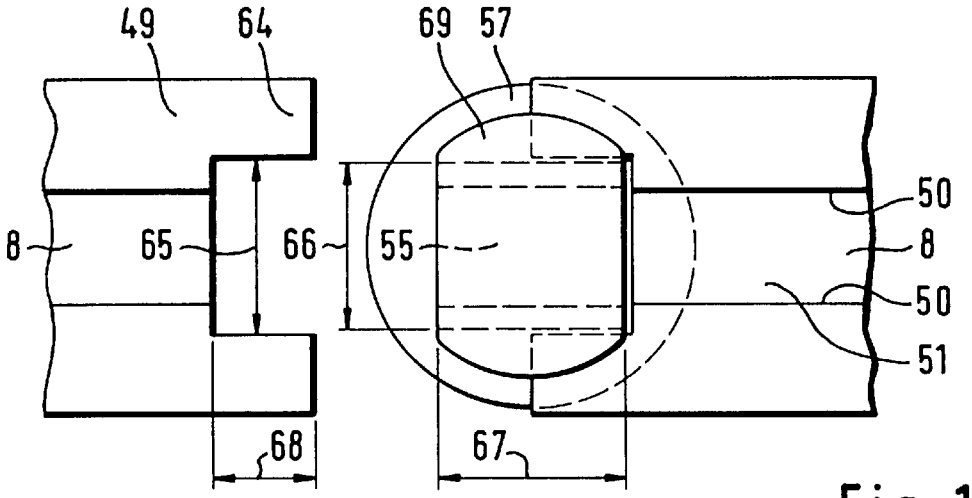
FIGS. 12–14 show a plan view, a side elevation and a front elevation of the securing lug with the clamp parts of the tool on an enlarged scale.
Figure 13:
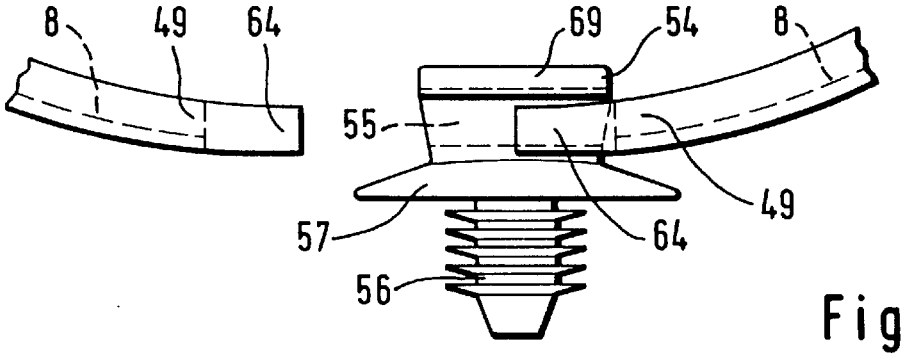
Figure 14:
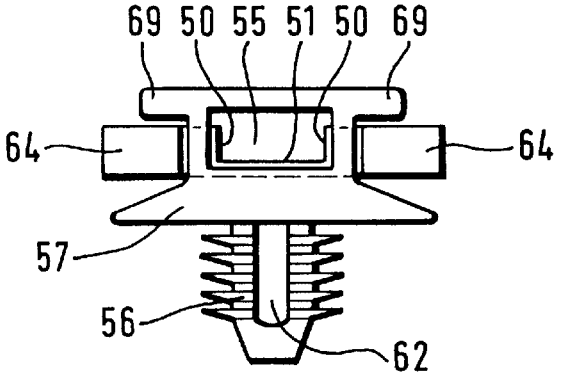
Figure 15:
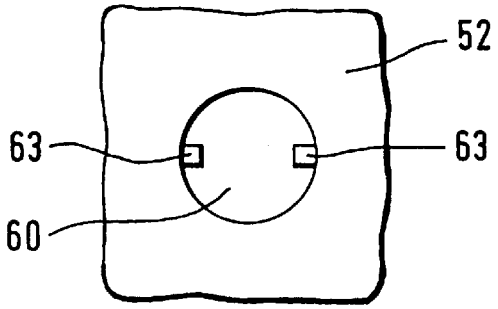
FIG. 15 shows a mount for a securing lug in a mounting, and FIGS. 16*a, b* show partial elevations of the tool in an embodiment with a movable lock mount.

Each mount possesses two walls 45, of which at least one, but preferably both, are designed with two limbs 44 to receive the cable harness, in the form which can be seen in FIG. 9. They face each other by internal surfaces 46, which enclose between them a channel 47 which broadens towards both ends and is narrowest at the centre. Its width at the narrowest position is slightly greater than the width 48 of the free ends 49 of the clamp parts 5, which are fitted to the tool body 1. In their open position (FIG. 9), they have an opening width which is greater than the thickness of the cable harness 12, so that they can be lowered around the latter into the channel 47 of the mount 43. In the event that, in this case, they should stand slightly obliquely, as is indicated in FIG. 10, the internal surfaces 46 of the walls 45 as well as the floor surface 52 of the channel 47 ensure, as guide surfaces, that during the closing movement, the direction of which is indicated by arrows in FIGS. 9 and 10, they are guided into their correct end position, which is illustrated in FIG. 11. In this way, the mount 43 forms a guiding device for the free ends 49 of the clamp parts 5.

The securing lug 7 is releasably secured at the centre of the mount 43. The securing lug 7 consists of a lug part 54 with a passage opening 55 to receive the band, and a foot part 56 which is bounded, at its end facing the lug part 54, by an elastically resilient dish 57. The foot part 56 is intended to be fixedly received, in the course of the final mounting of the cable harness 12, in a bore of the structure carrying the cable harness, for example the wall 14. For this purpose, it is designed with circulating retaining teeth which enable it to be pressed into the bore but which oppose with high resistance its removal therefrom. In this case, the dish 57 becomes applied to the surface of the holding structure and makes the lug free from unsteadiness. It is understood that the foot, which is represented merely by way of example, could be replaced by any other retaining construction.

The mount 43 includes, in its base surface 52, at the centre of the channel 47, where it is narrowest, a bore 60 as seating for the foot 56 of the securing lug. The bore 60 is dimensioned so that the foot of the securing lug is indeed reliably held therein for mounting purposes, but can be removed therefrom without the application of substantial force when the cable harness is completely fastened. The arrangement of the securing lug in the mount 43 makes it possible to bring up the free ends 49 of the clamp parts 5 to the lug part in such a manner that the guide grooves 8, which are provided on the internal surface of the clamp parts, adjoin the band opening 55 in aligned fashion. So that this is guaranteed, it is necessary to ensure that the band opening 55 extends in the direction of the channel 47 of the mount 43. For this purpose, the foot 56 of the securing lug has at least one longitudinal groove 62 and there is provided in the receiving bore 60 of the mount 43, at an appropriate position, a projection 63 which fits into the groove 62. Two projections 63 which lie diametrically opposite one another are shown in the receiving bore 60; in corresponding fashion, the foot 56 is also equipped with two grooves 62 which lie diametrically opposite one another.

The lateral guide surfaces 46 of the mount 43 guarantee that the free ends 49 of the clamp parts 5 are correctly centred between them in relation to the securing lug. This centring is sufficient in those cases in which it is guaranteed that the securing lug is mounted in all instances only with the use of such a mount or guiding device. In order that this should, as appropriate, be unnecessary, it is more advantageous to create an appropriate positive locking of the free ends 49 of the clamp parts 5, in relation to the securing lug as well. For this purpose, the free ends 49 of the clamp parts 5 end in each instance in a pair of fingers 64, the clear spacing 65 of which is approximately equal to or slightly greater than the width 66 of the lug part 54 transversely to the direction of the band opening 55. As a result of this, the fingers 64 receive the lug part between them and centre it. The width 67 of the lug part parallel to the direction of the band opening 55 is, in contrast, slightly greater than the clear width 65 between the fingers 64. Thus, it is impossible to accommodate the securing lug between the fingers 64 in an incorrect direction. The clamp parts 5 are unable to close if the positioning of the securing lug 7 is incorrect. Since the fastening procedure can be initiated only in circumstances in which they are closed, said procedure cannot take place in this case. The depth 68 of the intermediate space between the fingers 64 is approximately equal to one half of the width 67. However, it would also be feasible to provide the fingers 64 only at one of the two free ends 49 of the clamp parts. Their length would then be approximately equal to the width 67.

In order that the free ends 49 of the clamp parts 5 should adjoin the lug part 54 in a manner which is correct in terms of height as well (see FIGS. 12 and 14), the latter is provided, at its upper margin, with strips 69 which enclose together with the dish 57 or another projection of the securing lug an intermediate space which is approximately equal to the height of the fingers 64 of the clamp parts 5. The positive locking between the clamp ends and the securing lug not only in each lateral direction, but also in the height direction, accordingly guarantees that the guide grooves 8, which are provided in the clamp parts 5 and the flanks of which are designated by the reference numeral 50 and the floor of which is designated by the reference numeral 51, correctly adjoin the band opening 55; in this case, their boundaries are dimensioned to be slightly wider than those of the grooves 8, so that the band is conducted through in a manner free from disturbance, even in the event of customary tolerance deviations.

The example shows the direct positive locking between the tool and the securing lug. When the latter is mounted only with the aid of the guiding device 43, such positive locking can be replaced by an indirect positive locking between the tool and the guiding device.

The arrangement explained in the example provides a cable harness which is connected to the securing elements and which can subsequently be mounted in a very simple manner, because it is only further necessary to insert the correctly positioned securing elements into the holding openings of the carrying structure.

Figure 16A:
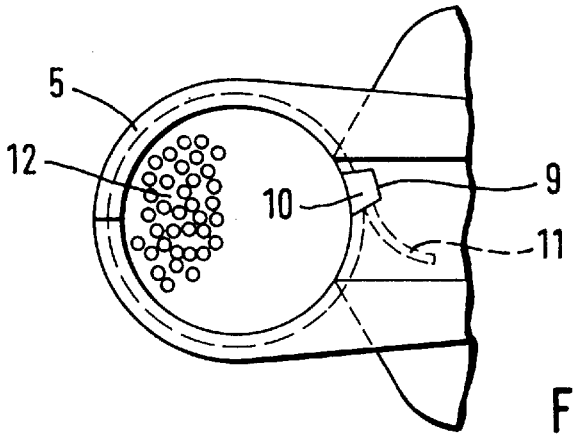
Figure 16B:
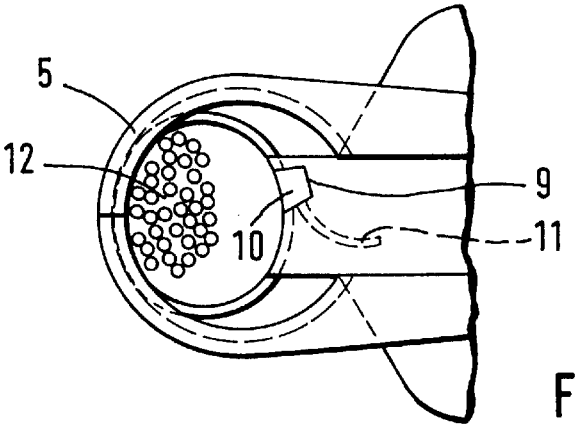

An embodiment of the tool with a leading lock mount 9 is represented in FIGS. 16*a, b*. Upon commencement of the tensioning of the band, the lock mount 9 is in its position closest to the tool body 1 (FIG. 16*a*). During the tensioning effected by the advance of the free end 11 of the band, the lock 10 and the lock mount 9 move away from the tool body 1 towards the band loop (FIG. 16*b*). In this case, the clamp parts 5 are still closed; this has the advantage that, even still during the tensioning procedure, the tool can be guided more easily, for example by cooperation with a carrying structure or a securing lug.

I claim:

1. Tool for fastening cable harness, by means of a band having a lock therein comprising a tool body having a forward end face with a mount for the band lock, a wraparound clamp movably mounted on the tool body and having front jaw members for releasably encircling the harness forwardly of the end face, the jaw members being provided with a band guide, a tensioning device for tensioning the band guided in the band guide and through the lock, and a control device for opening the jaw members of the wraparound clamp and tensioning the band, the control device being operative to open the jaw members and retract the wraparound clamp rearwardly relative to the end face before the completion of the tensioning of the band.

2. Tool according to claim 1, characterized in that the wraparound clamp is retractable through at least one half the distance between the front of the jaw members and the end face of the tool body.

3. Tool according to claim 1, characterized in that the wraparound clamp is retractable through at least one quarter of the greatest opening width between the jaw members.

4. Tool according to claim 1, characterized in that the tool body has a rearwardly extending track associated with each jaw member and each jaw member has two articulation points, one of which is guided along the track.

5. Tool according to claim 4, characterized in that each jaw member has a steering gear pivotably connected to the tool body and to the other of said articulation points, said one articulation point being slidable along the track.

6. Tool according to claim 4, characterized in that each jaw member has a steering gear pivotably connected to the tool body and the two articulation points are operatively connected to the steering gear.

7. Tool according to claim 1, characterized in that the jaw members comprise a base part and a replaceable part connected thereto, said replaceable part carrying the band guide.

8. Arrangement for fastening an article and a securing lug by means of a flexible band, which arrangement comprises a fastening tool having a tool body and movable jaws supported by the tool body and forming a band guide for guiding the band around the article, said jaws having free ends which adjoin the securing lug in their closed condition, said lug forming a part of the guide for the band.

9. Arrangement according to claim 8, characterized in that the free ends and the securing lug operatively cooperate in positive locking fashion.

10. Arrangement according to claim 9, characterized in that the securing lug is provided with an abutment at its side facing the article for cooperative engagement with the free ends of the jaws.

11. Arrangement according to claim 8, characterized in that the free ends are provided with at least one pair of spaced fingers which grip the securing lug between them in the closed condition, said lug having a band opening forming a part of the guide and the width of the securing lug, measured transversely to the direction of the band opening (55), is slightly smaller, and its width measured in the direction of the band opening is larger, than the spacing of the fingers from one another.

12. Arrangement according to claim 8, characterized in that the arrangement includes a guiding device releasably connected to the securing lug, said guiding device having guide surfaces leading towards the securing lug.

13. Arrangement according to claim 12, characterized in that the arrangement includes a setting board, the guiding device is secured to the setting board and has a seating for the securing lug.

14. Arrangement according to claim 13, characterized in that the seating and the securing lug are provided with means which cooperate in positive locking fashion, for orienting the securing lug onto the guiding device.

15. Arrangement according to claim 8, characterized in that the tool includes a lock mount movable toward the securing lug.

16. Arrangement according to claim 15, characterized in that the band forms a loop that diminishes in circumference during tensioning and the movement of the lock mount compensates for the diminution during tensioning.

* * * * *